United States Patent [19]

Marcoz

[11] 4,423,400

[45] Dec. 27, 1983

[54] CONTROL DEVICE TO BE MOUNTED IN A FRAME FOR OPERATING THE DISPLACEMENT OF AN ARM AND USE OF THE DEVICE IN PARTICULAR AS A SWITCH

[76] Inventor: Jean A. E. Marcoz, 93, avenu Albert 1er, 92500 Rueil Malmaison, France

[21] Appl. No.: 283,785

[22] Filed: Jul. 15, 1981

[51] Int. Cl.[3] ..... H01H 71/16

[52] U.S. Cl. ..... 337/72; 335/167; 337/73

[58] Field of Search ..... 335/26, 27, 167; 337/72, 73

[56] References Cited

U.S. PATENT DOCUMENTS

| | | | |
|---|---|---|---|
| 2,068,553 | 1/1937 | Linde | 200/89 |
| 2,960,587 | 11/1961 | Wood | 200/116 |
| 3,137,776 | 6/1964 | Maeda et al. | 337/72 |
| 3,171,921 | 3/1965 | Woods | 337/72 |
| 3,171,928 | 3/1965 | Powell | 200/116 |
| 3,305,806 | 2/1967 | Norden | 335/27 |
| 3,307,002 | 2/1967 | Cooper | 337/72 |
| 3,492,614 | 1/1970 | Angelo et al. | 337/72 |

*Primary Examiner*—Harold Broome

*Attorney, Agent, or Firm*—Steinberg & Raskin

[57] ABSTRACT

A control device for operating the displacement of an arm between an on-position and an off-position, comprising a control member operating through a transmission element consisting of a link and a locking means movable between a locked position and an unlocked position, the device being usable as an electric switch.

30 Claims, 13 Drawing Figures

CONTROL DEVICE TO BE MOUNTED IN A FRAME FOR OPERATING THE DISPLACEMENT OF AN ARM AND USE OF THE DEVICE IN PARTICULAR AS A SWITCH

BACKGROUND OF THE INVENTION

The present invention relates essentially to a control device to be mounted in a framework or like supporting structure for operating the displacement of an arm as well as to an application or use of such a device in particular as an electric switch.

In the switch devices or mechanisms known heretofore the locking of the contact was performed through the agency of a crank-connecting rod system comprising a large number of parts and the mounting of which is difficult while being of course of a relatively high cost in view of the number of parts and of the use of substantial labor or workmanship.

SUMMARY OF THE INVENTION

An object of the present invention is therefore to obviate the aforesaid inconveniences by providing an approach according to which the number of parts is reduced and the mounting or assembly is easy. Preferably that solution should moreover offer the advantages of occupying a smaller space than the prior art devices.

Furthermore the apparatus according to the present invention should preferably exhibit a versatile adaptability so as to be applicable not only to the locking of switch contacts but also to other general applications requiring the displacement of a mechanical element such as an arm.

This approach comprises according to the present invention in a device which may be mounted in a frame or like supporting structure for operating the displacement of an arm between at least two positions, namely a first so-called stop or off-position and a second so-called working or service position, characterized in that it comprises a member displaceable in a translatory and/or rotary motion in the plane of arm displacement between at least two positions, namely a first so-called "inoperative" position corresponding to said stop or off position of the arm and a second so-called "operative" position corresponding to said working or service position of the arm, for operating said arm through the agency of a transmission element bearing or resting on said arm in a freely slidable fashion for enabling said transmission element to be displaced along said arm and in its displacement plane and between at least three distinct advantageously non-aligned positions, namely a first so-called engaged or tripped in or set position, a second so-called disengaged or tripped out position and a third so-called reset or re-engaged position, for which aforesaid second and third positions said arm is in said stop or off position; and a locking or latching device advantageously comprising an elongate integral element bearing or resting in the locked position with one end against a stop means whereas the other end is connected (or bound in terms of travel) to said transmission element displaceable between at least two positions, namely a first so-called "locked" position and a second so-called "unlocked" position and furthermore assuming again its locked position when the transmission element is moved to its third resetting or re-engaging position.

This device advantageously comprises a self-acting means for automatically disengaging or tripping out said locking position to bring it into said disengaged or tripped out position.

According to a particular embodiment this device comprises a biassing means for returning or drawing the arm back to the first stop or off position.

According to another particular embodiment, sid transmission element includes one of the two ends of a so-called transmission link or connecting rod the other end of which cooperates with the control or actuating member. That link end which forms the transmission element advantageously engages or bears or rests in rolling or sliding contact relationship on said arm whereas the other end co-operating with the control member is pivotally connected thereto.

Preferably, this device moreover comprises an in particular resilient biassing means for returning or drawing the control member back to its initial "inoperative" position for which the arm is in said first stop or off position.

According to still a further particular embodiment that end of said elongate element which is connected to the transmission element is pivotally connected to said transmission element. Moreover the stop means may be stationary or comprise a shoulder against which the corresponding end of the elongate element will abut.

According to an alternative embodiment said stop means may be movable and in such a case said automatic disengaging means is advantageously designed to act upon the stop means so as to displace said stop means for disengaging or tripping out the locking device.

According to still another particular embodiment said transmission element and the locking device may be made in one integral piece and preferably the transmission element, the locking device and the control member may also be made in one integral piece thereby advantageously significantly simplifying the structure of the device.

This control device is in particular usable as a switch and therefore the present invention also relates to an application of said control device as a switch and in this case said arm is electrically conducting and comprises at its free end a contact piece co-operating in said second working position with an electrically conducting stationary contact element comprising a corresponding contact piece.

A plurality of said devices may advantageously be provided in parallel relationship in the same circuit or in different circuits. If several devices are arranged in parallel relationship there is then advantageously provided a means for coupling said control members to each other. According to an advantageous embodiment a single pivoting shaft is provided near that end of the elongate element of each aforesaid device which is opposite from that connected to the transmission element and comprises extensions associated with said ends and in a number equal to the number of elongate elements which, through a relative motion of the elongate elements together with the stop means they are co-operating with, are adapted to move the elongate elements away from or to cause them to no longer bear against the stop means, said pivoting shaft being provided with a stiff strip, blade, reed or like tongue in registering relationship with the axis of displacement or of disengagement of each elongate element so that when an elongate element is disengaged or tripped out said disengaged or tripped out element will act on its associated strip or blade and result in the pivoting motion of said pivoting shaft and of the extensions which are rigidly connected thereto and which would in turn cause the other locking devices to disengage or be tripped out so as to fully break or cut off the circuit or circuits.

It may thus be seen that the device according to the present invention has a reduced number of parts and that the mounting or assembling thereof is easy. Moreover it offers the advantage of occupying a much smaller room or space than the prior art devices. Likewise the addition of an in particular resilient biassing or drawback means such as a spring co-operating with the control member would, when the locking device is in unlocked position and when the end of the link forming the transmission element is freed or released and does no longer convey the large pressure force to the control member, enable the transmission element to move back to its first engaged or tripped in position while compulsorily passing through the third resetting position wherein the locking device assumes again its locked position, thereby making it possible to bring the arm then into the second working position for enabling the contacts to make in the case of the use of the device as a swich.

Furthermore upon the automatic disengagement or tripping of the locking device and the release of the arm, the movable mass of all of the parts being moved is small whereby the device according to the present invention may be used as a switch providing a quick opening of the movable contact piece rigidly connected with the arm to thereby break or cut off the electric current. Such a quick opening of the contacts would promote the cutoff or breaking of large currents.

Furthermore said arm is advantageously inclined with respect to the transmission element or to the end of the link likely to form the same, according to a predetermined angle of inclination or pitch so that arm portion which co-operates with the transmission element and forms a running or sliding trackway for the latter would cause the transmission element to roll or to slide on the arm upon tripping out or disengagement of the locking device. Moreover when the actuating mechanism is in the working position such as described hereinabove the very large force exerted on the arm is divided into two components one of which acts upon the transmission element and the other one corresponds to the pressure counterbalanced by the locking device. Therefore by selecting a suitable angle of inclination or pitch the force exerted upon the locking device would be weak enough to enable, when the device according to the present invention is used as a switch, the mechanism to be unlocked owing to a very small force with the assistance of the automatic disengaging means which may for instance consist of an electromagnetic release or trip means or of a bi-metallic strip.

Moreover as previously stated the device according to the present invention enables said arm to move between each one of said first stop or off position and said second working position while the locking device remains locked. That arrangement is advantageous because it avoids any untimely wear of the locking mechanism.

Moreover as previously stated when the device according to the present invention is used as a multiple-contact switch with parallel poles it enables through a simple system the locking device to be released from or locked off all the parallel poles when one of the poles senses the unlocking of its own unlocking device.

DESCRIPTION OF THE DRAWINGS

Further objects, characterizing features and advantages of the present invention will appear more clearly as the following explanatory description proceeds with reference to the attached diagrammatic drawings illustrating various presently preferred embodiments of the present invention, these embodiments being shown in the form of preferential application consisting in a design as a self-acting electric cut-out switch or automatic circuit breaker. In the drawings:

in FIGS. 1 and 2 the control member is in the operating position;

FIG. 10 illustrating the transmission element in its first engaged or tripped in position. FIG. 11 showing the transmission element in its second disengaged or tripped out position and FIG. 12 showing the transmission element in its third reset position.

DESCRIPTION OF THE PREFERRED EMBODIMENTS

Figure 1:
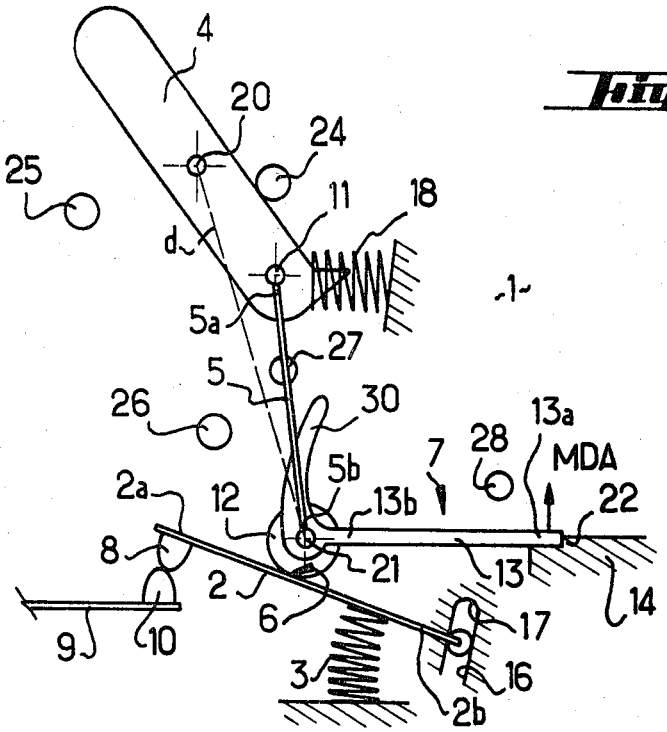
FIG. 1 diagrammatically shows a sectional view of a first embodiment of a control device according to the present invention, the arm being in said second working or closed or made position whereas the transmission element is in its first engaged or tripped in position and the locking device is in the locked position.
Figure 2:
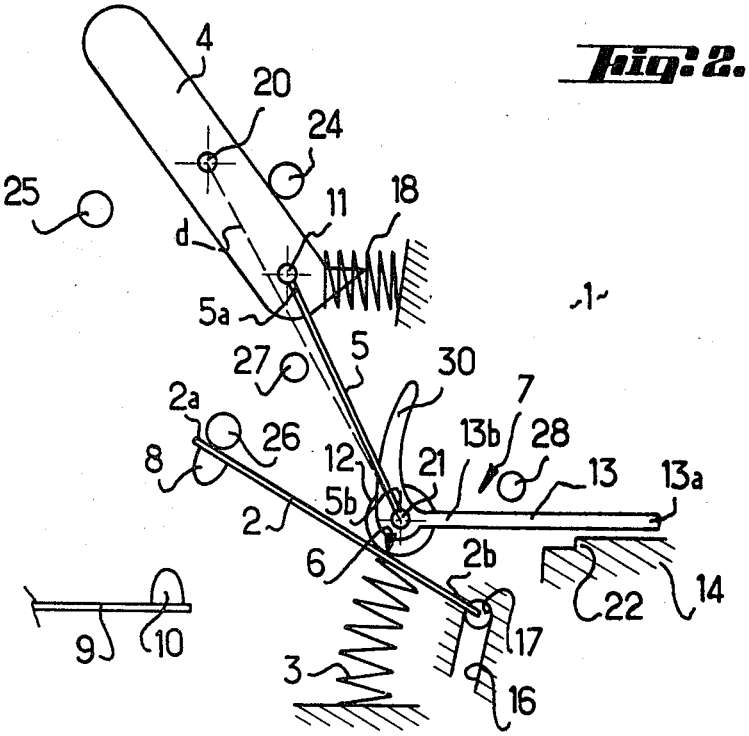
FIG. 2 illustrates the embodiment according to FIG. 1 in the unlocked position of the locking mechanism, the arm being then in its stop or off position and the transmission element in its second tripped out or disengaged position.
Figure 3:
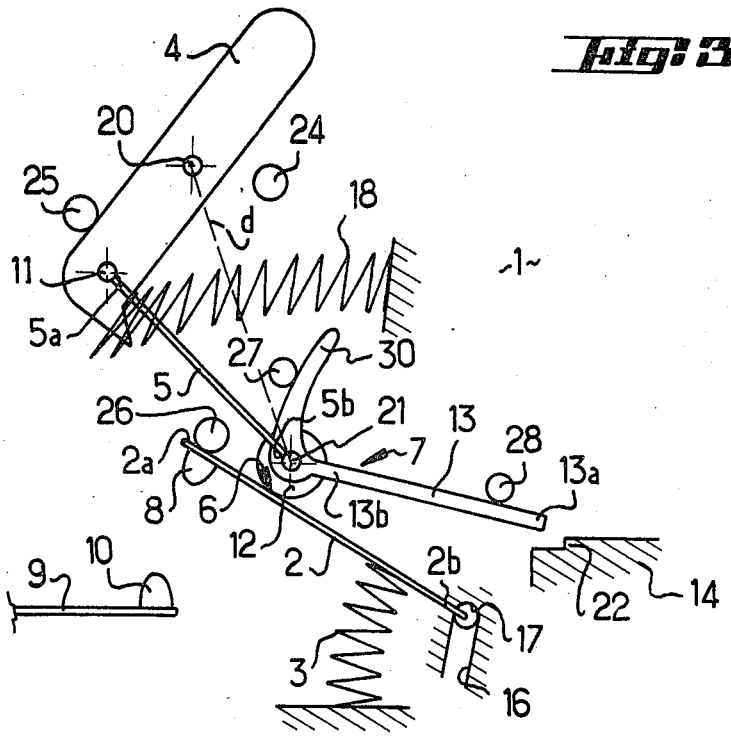
FIG. 3 is a view similar to those of FIGS. 1 and 2 and shows the device according to the present invention with the transmission element in its third resetting position shortly before the locking device assumes again its locked position shown in FIG. 1, the control member being brought back to its initial inoperative position.

Referring to the drawings and more particularly to FIGS. 1 to 3 thereof, there has been shown a device adapted to be mounted in a framework or like supporting structure 1 for controllably operating the displacement of an arm 2 between at least two positions, namely a first so-called stop or off position shown in FIGS. 2 and 3 and a second so-called working or service position shown in FIG. 1, advantageously comprising a biassing means 3 consisting in the exemplary embodiment shown of a spring for returning or drawing said arm 2 back to its first stop or off position.

According to the present invention, this control device comprises a member 4 movable in a translatory and/or rotary motion in the plane of travel of the arm, for controlling the arm 2 through the agency of a transmission element advantageously comprising in the exemplary embodiment shown of the end **5*b* of a transmission link or like connecting rod 5 bearing or resting at 6 on the arm 2 in freely sliding relationship to enable the transmission element 5*b* to move along the arm 2 and in its plane of displacement and between at least three advantageously non-aligned distinct positions, namely a first so-called engaged or tripped in position shown in FIG. 1 for which the arm 2 is in the working or service position, a second so-called disengaged or tripped position shown in FIG. 2 and a third so-called resetting ro re-engaging position shown in FIG. 3 for which second and third positions the arm 2 is in the stop or off position. This control device moreover includes a locking device 7 co-operating with the transmission element 5*b* while being connected thereto, which is displaceable between at least two positions, namely a first so-called locked position allowing the transmission element 5*b* to move between the first engaged and the third reset positions but preventing the transmission element from moving to its second disengaged or tripped out position through an action upon the control member 4, and a second so-called "unlocked" position shown in FIG. 2 and which on the one hand allows said transmission element 5*b* to move to its second disengaged position and on the other hand does not allow said transmission element to come back to its first engaged position otherwise than by necessarily going through the third reset position obtained by the return of the control member 4 to its inoperative position shown in FIG. 3, said locking device 7 assuming on the other hand again its locked position when the transmission element is shifted to its third reset position as clearly shown in FIG. 3**.

According to the embodiment shown in FIGS. 1 to 3, the device according to the present invention is used as a switch and in such a case the arm 2 is electrically conducting and comprises at its free end **2*a* a contact piece 8 co-operating in the second working position shown in FIG. 1 with a stationary contact element 9 comprising a corresponding contact piece 10** and electrically conducting.

The device according to the present invention advantageously comprises a self-acting release or tripping means MDA for disengaging the locking device 7 to bring it back to the disengaged or tripped out position shown in FIG. 2. According to a particular embodiment the locking device 7 comprises an elongate element 13 bearing or resting in the engaged or tripped in position of the transmission element **5*b* shown in FIG. 1 with one end 13*a* against a stop means 14 whereas the other end 13*b* is connected to the transmission element 5*b***.

When the device is used as a switch, the automatic release or trip means MDA preferably comprises a release or trip means of the thermal type such as a bimetallic strip or of the electro-magnetic type. The automatic release or trip means MDA may suitably be constituted by any mechanical means exerting a force upon the end **13*a* and which would cause the locking device 7** to be disengaged or tripped out when a displacement, a pressure, a temperature or a measure of any quantity exceeds a predetermined value or magnitude.

According to another characterizing feature of this device according to the present invention end **5*b* of the link forming the transmission element bears or rests in rolling or sliding contact relationship at 6 on the arm 2 whereas the other end 5*a* co-operating with the control member 4 is pivotally connected at 11 to the control member 4. In the exemplary embodiment shown in particular in FIGS. 1 to 3, the link 5 bears or rests through rolling engagement by having its end 5*b* forming the transmission element provided with a roller 12** which in the application as a switch is advantageously insulated.

It should be pointed out that according to another characterizing feature of this device the arm 2 is inclined or tilted with respect to the link 5 according to a predetermined angle of inclination or pitch so that the arm forms a runway or slideway or like track for the transmission element 5A of the link 5 in order that the transmission element **5*b* will normally have a tendency to roll or to slide on the arm 2 upon the locking of the locking device 7 as this may be seen by comparing the positions shown in FIGS. 1 and 2**.

Figure 9:
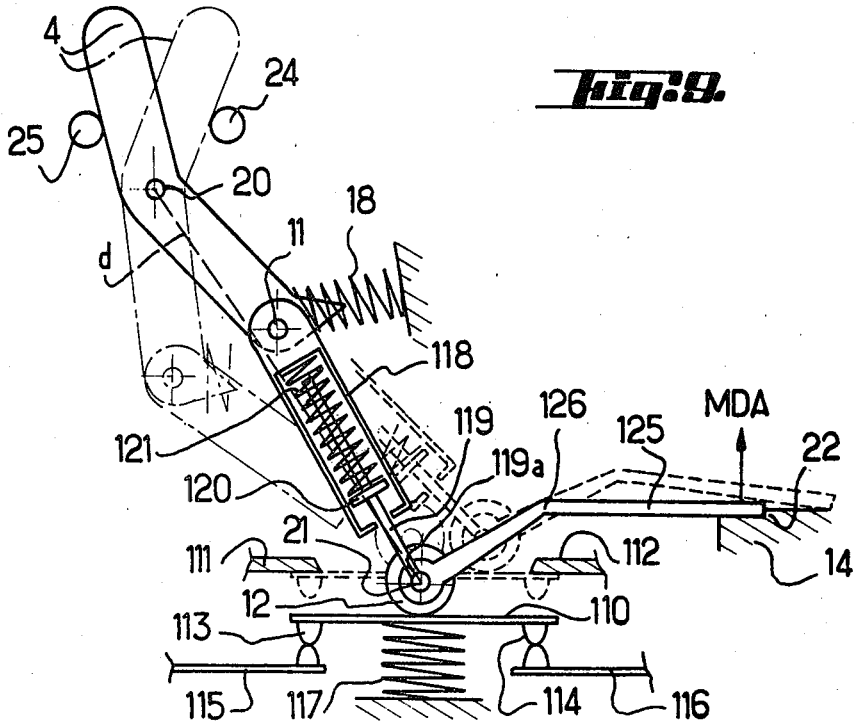
FIG. 9 shows still another alternative embodiment wherein the transmission element comprises one end of a link or connecting rod, the locking device and the control member being made in one integral piece.

According to a further characterizing feature of this device the arm 2 is pivotally and slidably mounted with one **2*b* of its ends 2*a*, 2*b* situated in a notch or slot 16 formed in the frame 1, the return means 3 for the arm 2 pushing the arm 2 towards the back end 17 of the notch or slot 16 so as to then allow the contacts to open when the transmission element 5*b* does not bear or rest on the arm 2 as clearly shown in FIGS. 1 and 2 in particular. It should be noted that this characterizing structural feature also serves to compensate for the mounting slacks, plays or clearances or for the wear of the contacts due to the cutout or breaking of the electric current. It may also be noted that other shapes of the contact arm may be employed. Thus may be used for instance a resilent flexible strip or yielding blade or a contact bridge such as that shown in FIG. 9** and which will be described later.

Furthermore according to another advantageous characterizing feature this device comprises in addition an in particular resilient biassing means 18 such as a spring for returning or drawing the control member 4 back to its initial inoperative position for which the arm 2 is in the first stop or off position. In the exemplary embodiment shown in FIGS. 1 to 3 in particular the control member 4 consists of a handle or grip pivotally mounted on a pin 20 which has a stationary position.

According to still another characterizing feature of this device the end **13*b* of the elongate element 13 connected to the transmission element 5*b* is pivotally connected at 21 to the transmission element 5*b***.

According to the exemplary embodiment illustrated in FIGS. 1 to 3, the stop means 14 is stationary and consists of a shoulder 22 against which the corresponding end **13*a* of the elongate element 13** would abut.

Moreover in order to facilitate the operation of this device the latter further comprises various stop means 24, 25, 26, and guiding means 27, 28 limiting and guiding the travel of each one of the aforesaid parts of the device according to the present invention. Furthermore the elongate element 13 may advantageously include a possibly resilient extension 30 formed with a cam contour for causing the opposite free end 13*a* of the elongate element 13 to be brought back to the engaged or tripped in position as well seen on FIG. 3 through co-operation of said cam contour with one of the aforesaid stop means and/or one of the aforesaid guide means upon the displacement of the control member 4 from said second working position to said first stop or off position. The operation of this device illustrated on FIGS. 1 to 3 is particularly simple and as follows:

With the locking device 7 locked as shown in FIG. 1 through displacement of the control member 4 in operative position shown in FIG. 1, the transmission element 5*b* of the transmission link or connecting rod 5, guided by the locking device 7, causes the arm 2 to pivot until the latter is brought to the forced bearing position wherein it rests against the contact element 9 thereby closing or completing the circuit of the electric current. It should be noted that in this working position the point 11 of pivotal connection between the transmission element 5*b* and the control number 4 has moved beyond the straight line d passing through the point of pivotal connection 21 of the roller 12 and through the pivot pin 20 of the control member 4, thereby enabling the control member 4 to be kept in its operative position corresponding to the working position of the arm 2. Moreover it should be noted that the device is adapted to be freely released, disengaged or tripped because even when the control member 4 is locked in the operative position shown in FIG. 1, the breaking or opening of the circuit may be safely obtained through the predetermined action of the automatic release or trip means MDA since then would occur the lifting or raising of the end 13*a* of the elongate element 13 and through the action of the return means 3 of the arm 2, the displacement of the transmission element 5*a* hence of the link 5 to lead to the disengaged or released position shown on FIG. 2 wherein the circuit of electric current is open or broken.

All the advantages previously mentioned in the introductory part of the description are thus achieved.

Figure 4A:
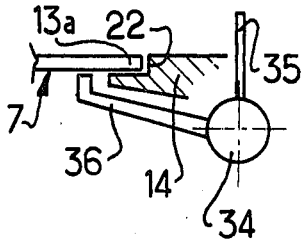
FIG. 4*a* is a view in section taken at a stop means of one of the devices shown in FIG. 4.
Figure 4:
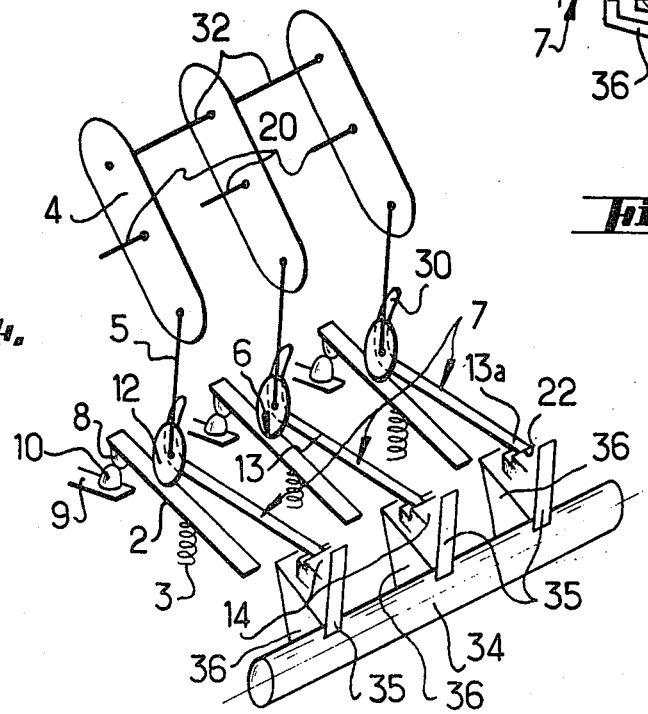
FIG. 4 shows a plurality of devices according to the present invention associated in parallel relationship to form a multipolar or gang switch.

Referring to FIG. 4 there is shown a plurality of devices according to FIGS. 1 to 3 arranged in parallel relationship to form a multipolar or gang switch. Thus there is advantageously provided in this case various means such as 32 for coupling the control members 4 to each other. Moreover a single pivoting shaft 34 is provided near that free end 13*a* of the elongate element 13 of each locking device 7 which is opposite from that 13*b* connected to the transmission element 5*b* and comprises extensions 36 associated with said ends 13*a* in a number equal to the number of elongate elements 13 and which are adapted through a relative displacement of the elongate elements 13 together with the stop means 14 with which they co-operate, to discontinue the engagement of the elongate elements 13 with the stop means 14. Moreover this pivoting shaft 34 is provided with a stiff strip or blade 35 in the axis of travel or of disengagement of each elongate element 13 so that when one elongate element 13 is disengaged or tripped out, said disengaged element acts upon its associated strip or blade 35 and produces the rotation of the pivoting shaft 34 and of the extensions 35 which are rigidly connected thereto and which in turn cause the other locking devices 7 to be disengaged or tripped so as to fully break or cut out the circuit. In the exemplary embodiment shown in FIG. 4*a* the stop means 14 are stationary and the extensions 36 of the shaft 34 extend under the adjacent stationary stop means 14 so as to be able to discontinue the bearing engagement of each end 13*a* of the elongate element 13 with the stop means 14.

It should be understood that multiple modifications of the embodiment shown in FIGS. 1 to 3 are possible.

Figure 6:
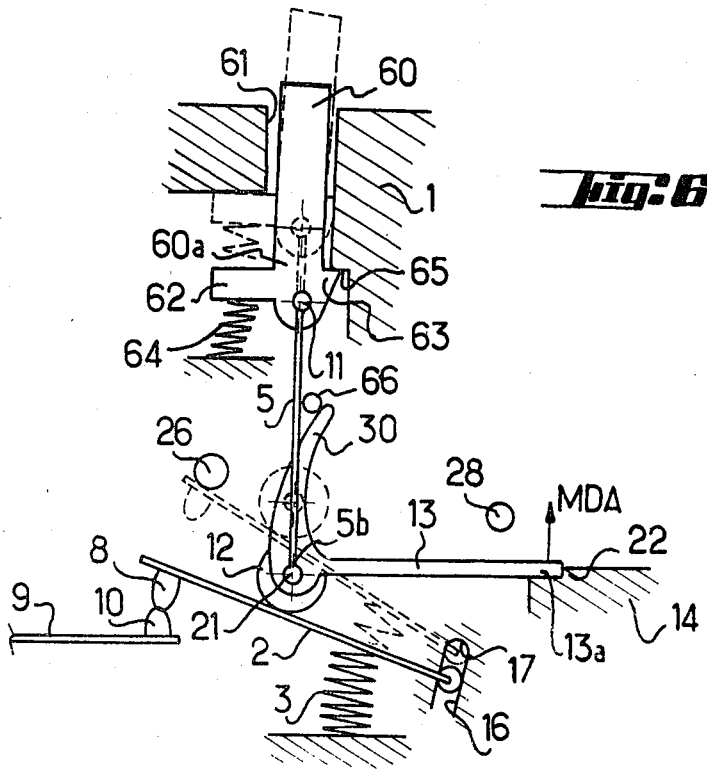
FIG. 6 illustrates still another embodiment showing another modification of the locking device.

In particular with reference to FIG. 6, the elongate element 50 may be pivotally mounted about a pin 51 having a stationary position and placed at a point spaced from its ends 50*a* and 50*b* so that its end 50*a* opposite from that 50*b* connected to the transmission element 5*b* bears or rests in locked position against a stop 52 which in the exemplary embodiment shown is movable and comprises a shoulder 55 forming a stop in the locked position for the element 50 which may be formed for instance with a corresponding recess 56. In such a case the automatic release or trip means MDA may be advantageously provided for actuating the stop 52 so as to unlock the locking device 7. According to a particular characterizing feature the end 5*b* forming the transmission element of the link 5 may be pivotally connected in sliding relationship with the elongate element 50 which comprises for this purpose a slideway groove or slot 58. The reset position is shown in phantom or broken lines.

Figure 5:
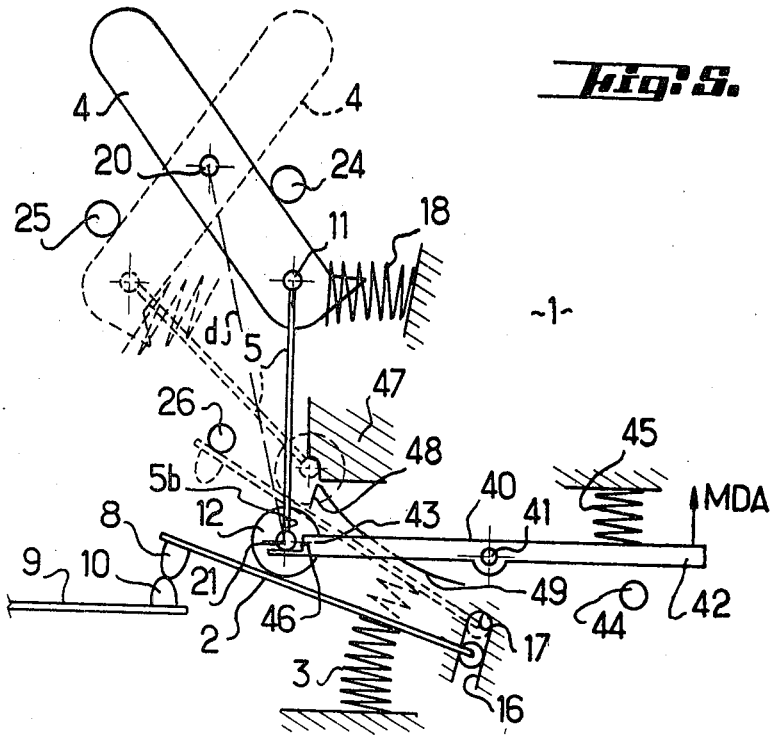
FIG. 5 shows another alternative embodiment of the device illustrated in FIGS. 1 to 4 wherein the control member comprises a push-button, the drawing also only showing both engaging and resetting positions of the transmission element for the sake of a better clarity of the drawing.

According to still another alternative embodiment shown in FIG. 5 said control member may be constituted by a push button 60 displaceable according to a translatory motion within a notch 61 of the frame 1 and which may comprise at its end 60*a* co-operating with the link 5 two shoulders 62, 63 forming projections extending outwards from and on either side of said end 60*a* advantageously in symmetrical relationship, one shoulder 62 serving as a bearing point for a biassing means 64 adapted to return the control member 60 to the first stop or off position and the other shoulder 63 co-operating with a corresponding recess 65 of the frame forming a stop for the control member 60 in the second working position such as shown. It should be noted that the first stop or off position is shown in phantom or broken lines. Moreover there is provided a stop 66 engageable by the transmission element 5*b* of the link 5 so that upon the unlocking of the elongate element 13 under the action of the automatic trip means MDA, the stop 66 acts upon the transmission element 5*b* in order to drive the shoulder 63 of the push button 60 out of the recess 65 and to thereby enable the push button to move upwards. For the closing or making of the device the combination of the resilient return means 64, of the guide means 28 and 66 and of said extension 30 of the elongate element 13 makes it possible to bring the elongate element 13 to the locked position shown in solid lines while bringing the arm 2 into the second working position shown in solid lines according to the operating principle described in relation to FIGS. 1 to 4.

Figure 7:
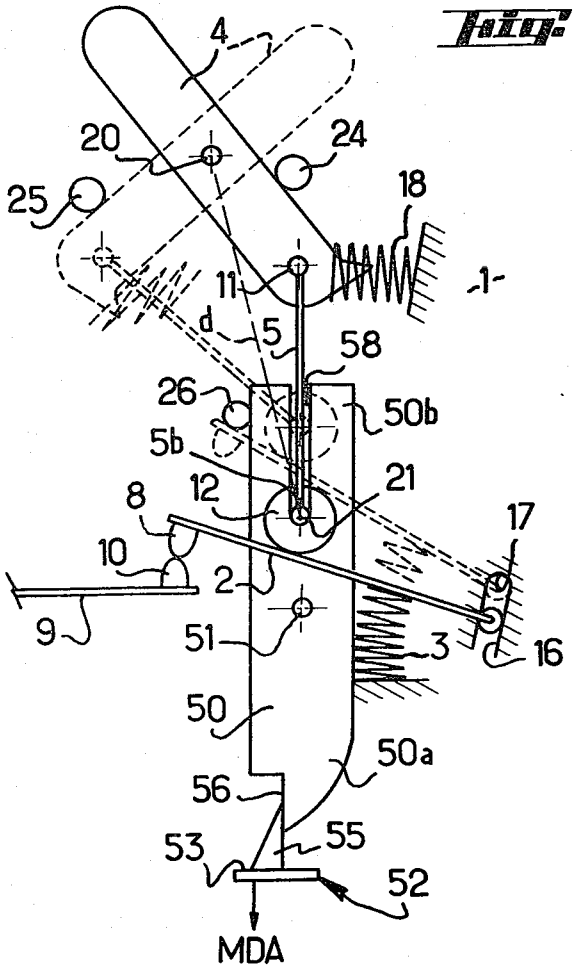
FIG. 7 shows another alternative embodiment wherein the transmission element comprising one end of a link or connecting rod and the locking device are made in one integral piece.

Another alternative embodiment is shown in FIG. 7. In this case the transmission element constituted by one end of said transmission link and said locking device are made in one single integral piece consisting of a bar having at a place spaced from its ends 100*a*, 100*b* a resilient bend or elbow 101 forming the transmission element serving as a bearing point for the linklocking device assembly on the arm 2. The released and unlocked position is shown in dotted lines whereas the rest position is shown in phantom lines. According to still a further particular embodiment illustrated in FIG. 9, said transmission element is constituted by one end of said transmission link; the locking device and the control member may be constituted by one single integral piece 70 consisting of a bar having at a place spaced from its ends 70*a*, 70*b* a resilient bend or elbow 71. It may thus be considered that the bend or elbow 71 forms the transmission element, the end 70*a* of the bar 70 forms the locking device, the end 70*b* forming the transmission link the end portion of which forms the control member 70*c* constituted by a push button displaceable in translatory motion in the frame 72. The push button advantageously comprises a shoulder 73 co-operating with a corresponding contour 74 of the frame 72, a resilient drawback means 75 being advantageously provided to drive the push button 70*c* from the integral piece 70 towards the reset position shown in phantom lines.

Figure 8:
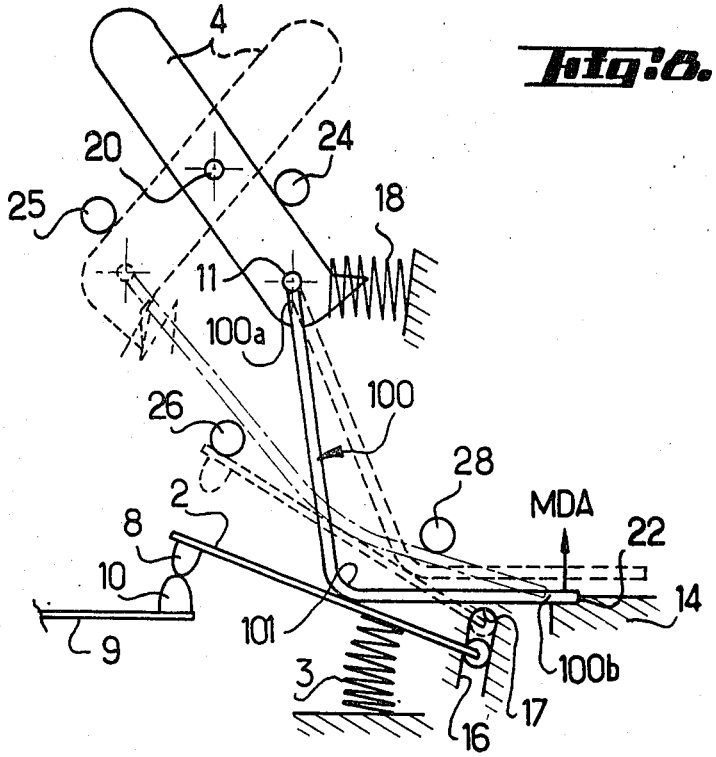
FIG. 8 illustrates another embodiment of the link and of the locking device according to the present invention.

Referring to FIG. 8 there is shown another embodiment wherein the arm 110 is mounted in bridge-like fashion between two edges 111, 112 of the frame and comprises two contact pieces or studs 113, 114 with two corresponding contact elements 115, 116, respectively. The arm 110 is pushed towards the edges 111, 112, by the action of a resilient biassing means 117 such as a spring. According to a particular characterizing feature of this embodiment said transmission link may include a hollow body or casing 118 wherein is slidable a rod 119 including a retaining collar 120 forming an abutment for a spring 121 urging the rod 119 out of said hollow body or casing 118. The collar 120 also serves as a slideway stop for the rod 119 the free end 119*a* of which actually forms said transmission element bearing on said arm 110.

On the other hand said elongate element of the locking device 7 may be advantageously constituted by a bar 125 cranked or bent at 126 at a place spaced from its ends so that the spring 121 provided inside of the hollow body 118 of the transmission link compensates through the resilient bend or elbow 126 for the action of the return means 117. It should also be noted in this case that in the working position shown in solid lines the pivotal connection 11 of the link 118 with the control member 4 is located beyond the straight line d passing through the pivot pin 20 of the control member 4 and the point of pivotal connection 21 of the roller 12. In this case the spring 121 makes it possible to exert a pressure upon the contact pieces or studs 113, 114 so as to compensate for or take up their wear since it acts against the return means 117. This embodiment moreover makes possible a quicker opening of the contacts.

Figure 10:
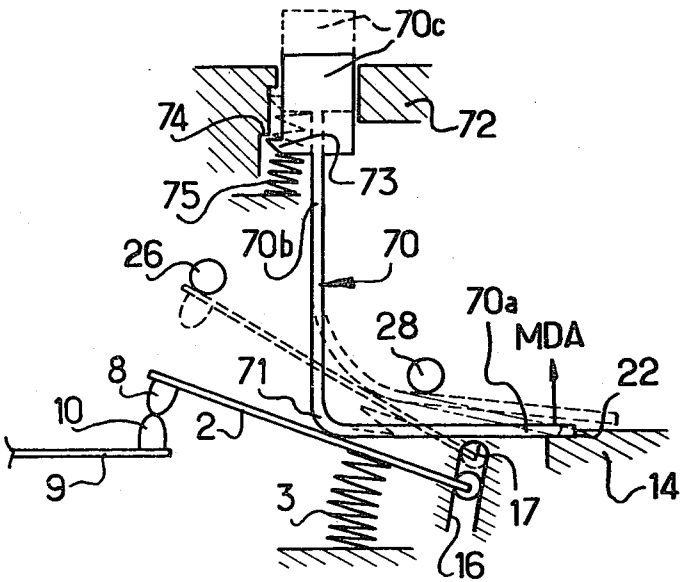
FIGS. 10 to 12 show still another embodiment of the control device according to the present invention.
Figure 11:
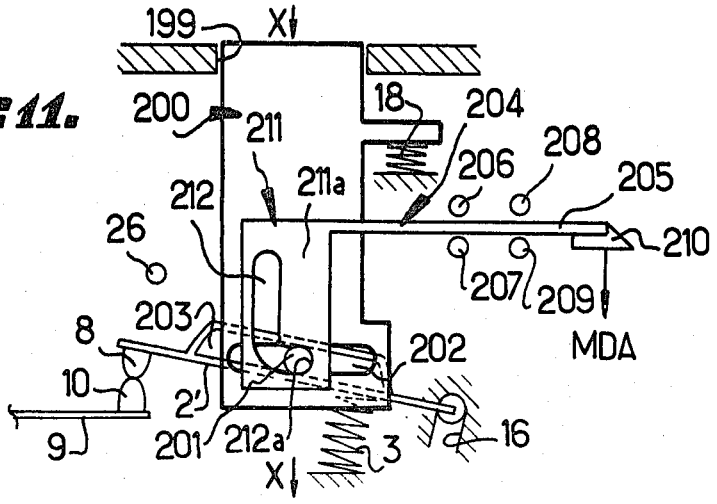
Figure 12:
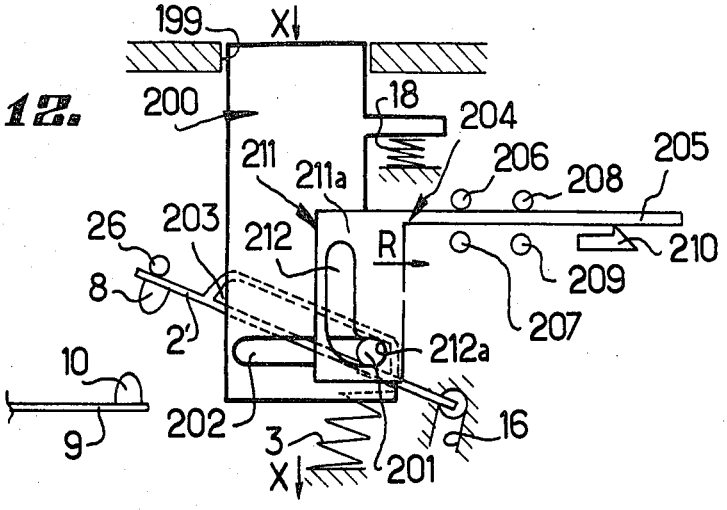
Figure 13:
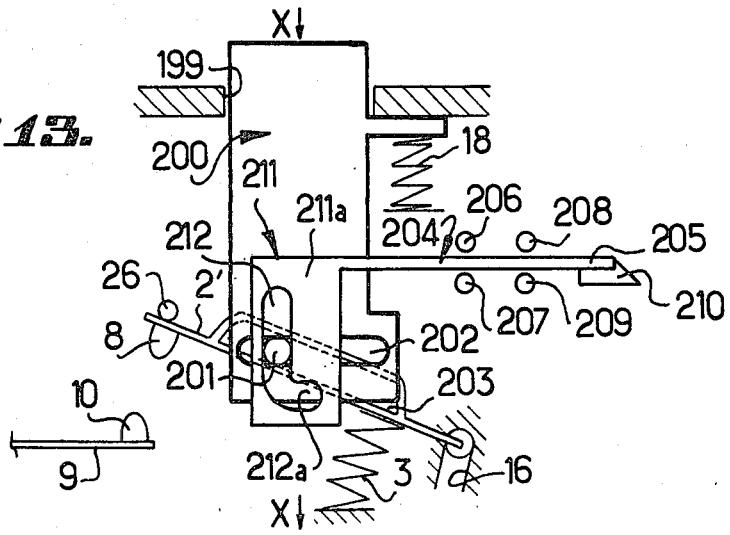

Referring to FIGS. 10 to 12 and according to still another alternative embodiment said control member is constituted by a push button 200 displaceable in translatory motion within a notch or opening 199 of the frame which push button 200 comprises at its end co-operating with said transmission element 201 a slot 202 which is well seen in FIG. 11 and arranged substantially at right angles at the axis of translatory motion X—X of the push button 200. The transmission element 201 comprises a transmission pin accommodated in the slot 202 and extending moreover through a groove 203 formed in the body of the arm 2' and along the arm 2' over a predetermined distance. The locking device 204 comprises an elongate element including a rod-shaped portion 205 the displacement of which is guided between two series of stationary stops 206, 207; 208, 209; that aforesaid stop 210 of the end of the elongate element 205 which is opposite to that co-operating with the transmission element 201 is movable and operable by the automatic release or trip means MDA for unlocking the locking device 204.

According to a particular characterizing feature the locking device 204 has its elongate element 205 which includes an end connected to the transmission element 201, a laterally extending portion 211 curved or bent along the push button 200 and formed with a groove or slot 212 into which extends the transmission element, said groove or slot extending mainly in substantially parallel relation to the axis X—X of translatory motion of the push button 200 and having an extension 12*a* of suitable shape arranged generally substantially at right angles to the axis of translatory motion X—X.

According to the exemplary embodiment shown the push button 200 comprises at its end co-operating with the transmission element 201 a central recess or notch defining two end flanges or cheeks for the push button 200, said slot 202 of the push button 200 being provided on each cheek so that the transmission pin forming the transmission element 201 extends fully through said cheeks while passing into said recess or notch and advantageously projects outwards from the contour of the push button 200. Moreover the arm 2' in the groove 203 of which extends the transmission element 201 is housed within said notch or recess in freely pivoting relationship as well seen in FIGS. 10 to 12.

Furthermore, the curved or bent portion 211 of the elongate element 205 comprises two flanges of which the flange 211*a* is seen and which are arranged on either side and outside of said push button, each flange comprising said cut-out or recess 212, the projection portions of the transmission element 201 extending into the recess or cut-out 212 of each flange.

The operation of this device is particularly simple.

From the third reset position shown in FIG. 12, through an action upon the push button 200 in the direction of the arrow shown in FIG. 12, the transmission element 201 is caused to slide within the groove 203 and in the recess or cut-out 212 up to its extension 212*a* so as to come in the engaged or tripped in position shown in FIG. 10 for which the arm 2' is in the working position. Upon unlocking the locking device 204 under the action of the automatic trip or release means MDA and under the action of the various return means such as the spring 3, the elongate element 205 of the locking device moves to the right in the direction of the arrow R shown in FIG. 11 and the transmission element 201 moves in the slot 202 of the push button down to the position shown in FIG. 11 for which the transmission element 201 is in said second disengaged position. When the transmission element 201 abuts against the side edge of the slot 202 a slight shock occurs with the attendant stop of the rightward motion of the locking device 204 causing the transmission element 201 to leave the extension 212*a* of the cut-out or recess 212 to return into the recess 212 proper thereby releasing or freeing the push button 200 which moves upwards into the inoperative position as shown in FIG. 12, the transmission element 201 having them moved back into its third reset position, which motion has brought the locking device 204 into the locked position as well seen in FIG. 12.

It should be understood that the invention is not at all limited to the embodiments described and shown which have been given by way of example only and it may be pointed out in this connection that any and all of the alternative embodiments set forth previously may in general be combined together. Also according to an alternative embodiment the push button may be provided for sidewise displacement.

Thus the invention comprises all the means constituting technical equivalents of the means described as well as their combinations if same are carried out according to its gist and used within the scope of protection as claimed.

What is claimed is:

1. In an apparatus including an arm and a control device adapted to be mounted in a frame for controllably operating the displacement of said arm in a plane between at least two positions, including a first off position and a second working position, the improvement wherein said control device comprises:

a control member mounted for movement in the plane of displacement of the arm between at least two positions including a first inoperative position corresponding to said off position of said arm and a second operative position corresponding to said working position of said arm, a transmission element coupled to said control member and bearing on said arm in freely moving engagement therewith so as to be movable along said arm in the plane of displacement of the arm between at least three positions including a first engaged position wherein the arm is in said working position, a second disengaged position and a third reset position wherein in said second and third positions, the arm is in said off position; and a locking device including an integral elongate element having two ends, said locking device mounted for displacement between at least two positions including a first locked position and a second unlocked position, and stop means, one end of said elongate element adapted to bear against said stop means wherein said locking device is in said locked position, the other end of said elongate element being connected to said transmission element, and wherein said locking device is displaced to said locked position when said transmission element is moved toward said third reset position.

2. The combination of claim 1 further comprising automatic trip means for releasing said one end of said elongate member from said stop means whereupon said locking device displaces to said unlocked position.

3. The combination of claim 1 further comprising biassing means cooperating with said arm for displacing the arm to said first off position.

4. The combination of claim 1 wherein said transmission element comprises one end of a transmission link, the latter having two ends and wherein the other end of said transmission link is coupled to said control member.

5. The combination of claim 4 wherein said end of said transmission link which comprises said transmission element is in one of rolling and sliding engagement with said arm and wherein said other end of said transmission link is pivotally connected to said control member.

6. The combination of claim 4, wherein said arm is inclined with respect to said transmission link and defines an angle of inclination therewith.

7. The combination of claim 1 further comprising biassing means cooperating with said control member for moving said control member to said inoperative position whereas said arm is in said first off position.

8. The combination of claim 1 wherein a recess having a terminal end is formed in said frame and wherein an end of said arm is received in said recess for mounting said arm for pivotal and slidable displacement, and further including biassing means for urging said arm towards said terminal end of said recess.

9. The combination of claim 1 wherein said other end of said elongate element of said locking device is pivotally connected to said transmission element.

10. The combination of claim 1 wherein said stop means is fixed in position and comprises a shoulder against which said one end of said elongate element of said locking device bears in abutting relation wherein said locking device is in said locked position.

11. The combination of claim 4 wherein said elongate element is pivotally mounted about a fixed pivot axis, said pivot axis being situated at a position which is spaced from said ends of said elongate element, and wherein said one end of said elongate element is spaced by a predetermined clearance from said stop means, and further including resilient return means for urging said one end of said elongate element against said stop means wherein said locking device is in said locked position.

12. The combination of claim 11 further including automatic trip means for releasing said other end of said elongate member from said stop means and wherein said stop means is movably mounted, said automatic trip means being adapted to act upon said stop means to move the latter for unlocking said locking device.

13. The combination of claim 4 wherein said transmission link and said locking device are constituted by a single integral piece comprising a bar formed with a resilient bend portion at a position spaced from its ends, and wherein said transmission element is constituted by said bend portion.

14. The combination of claim 4 wherein said transmission link, said locking device and said control member are constituted by a single integral piece.

15. The combination of claim 4 wherein said control member comprises a push button mounted in a notch formed in said frame for translatory displacement therewithin.

16. The combination of claim 15 further comprising biassing means for urging said control member to said first inoperative position and a recess formed in said frame, wherein said push button is formed at a region thereof at which said other end of said transmission link is coupled thereto with a pair of outwardly projecting shoulders arranged on either side of said region, said biassing means bearing against one of said shoulders, and wherein the other of said shoulders cooperates with said recess in said second operative position.

17. The combination of claim 4 wherein said transmission link comprises a hollow body, a rod slidably disposed in said hollow body, spring means situated in said hollow body, said rod including retainer collar means for abutting with said spring means for urging said rod out of said hollow body, said retainer collar means further constituting means for stopping the sliding movement of said rod, an end of said rod constituting said one end of said transmission link bearing on said arm.

18. The combination of claim 5 wherein said elongate element comprises a rod-like portion, at least two stationary stops for guiding the displacement of said rod-like portion, and wherein said stop means against which said one end of said elongate element is adapted to bear is movably mounted, and further including automatic trip means for moving said stop means to release said one end of said elongate element from said stop means whereupon said locking device displaces to said unlocked position.

19. The combination of claim 1 wherein said control member comprises a push button mounted in a notch formed in said frame for translatory displacement along an axis therewithin, said push button having a slot formed in a region thereof at which said transmission element is coupled thereto, said slot extending substantially at a right angle to the axis of displacement of said push button, said transmission element comprising a transmission pin accommodated within said slot, and wherein a groove is formed in said arm extending over a certain distance thereof, said transmission pin also being accommodated in said grove, said elongate element of said locking device including a laterally extending portion at its said other end connected to said transmission element extending along said push button and having a recess formed therein through which said transmission pin also extends, said recess including a main portion extending substantially in parallel relation to the axis of translatory displacement of said push button and an extension portion extending substantially at a right angle to said axis of translatory movement of said push button.

20. The combination of claim 19 wherein said push button comprises a central notch at said region thereof at which said transmission element is coupled thereto, said central notch defining two end cheeks for said push button, said slot of said push button being formed in each of said cheeks so that said transmission pin extends fully through said cheeks while passing into said notch and projects outside the contours of said push button, and wherein said arm is freely pivotally housed within said notch, and wherein said laterally extending portion of said elongate element includes two flanges arranged on respective outward sides of said push button, each of said flanges bordering said recess, and wherein the ends of said transmission pin extend into said recess in each flange.

21. The combination of claim 1 further including limiting; means for limiting and guide means for guiding the travel of said control member, transmission element and said locking device.

22. The combination of claim 21 wherein said elongate element further comprises an extension having a cam-shaped contour and adapted to cooperate with at least one of said limiting and guide means upon the movement of said control member from said second unlocked position to said first locked position wherein said one end of said elongate element bears against said stop means.

23. The combination of claim 1 wherein said apparatus comprises an electric switch, and wherein said arm is formed of an electrically conductive material and includes a contact piece at a free end thereof, said contact piece engaging a stationary electrically conducting contact element when said arm is in said second working position.

24. The combination of claim 23 further including automatic trip means for releasing said one end of said elongate member from said stop means whereupon said locking device displaces to said unlocked position.

25. The combination of claim 24 wherein said automatic trip means comprises a thermally actuated mechanism.

26. The combination of claim 25 wherein said automatic trip means comprises a bi-metallic strip.

27. The combination of claim 24 wherein said automatic trip means comprises an electro-magnetic mechanism.

28. The combination of claim 1 further including several of said arms and said control devices arrayed in parallel relationship, and means for coupling respective ones of said control members of said control devices to each other to form a multipolar switch.

29. The combination of claim 28 further including a pivotable shaft situated proximate to said one end of said elongate element of each of said control devices, said shaft including extensions, each extension being associated with a said one end of a respective elongate element, said extensions being adapted to disengage said one ends of said elongate elements from respective ones of said stop means through a relative displacement of said elongate elements together with said stop means, said pivotable shaft further including a rigid strip in the axis of displacement of each of said elongate elements so that upon disengagement of said elongate elements, each said disengaged elongate element acts upon said strip to cause said pivotable shaft together with said extensions to pivot, said extensions thereby causing said locking devices to be disengaged.

30. The combination of claim 23 wherein said transmission element comprises an insulating roller.

* * * * *